United States Patent [19]

Dietze et al.

[11] Patent Number: 4,475,206

[45] Date of Patent: Oct. 2, 1984

[54] METHOD AND DEVICE FOR TAPPING A FURNACE CONTAINING A TAPPABLE MELT

[75] Inventors: Wolfgang Dietze; Jürgen Schäfer, both of Munich, Fed. Rep. of Germany

[73] Assignee: Siemens Aktiengesellschaft, Berlin and Munich, Fed. Rep. of Germany

[21] Appl. No.: 478,289

[22] Filed: Mar. 24, 1983

[30] Foreign Application Priority Data

Mar. 29, 1982 [DE] Fed. Rep. of Germany ..... 3211525

[51] Int. Cl.[3] ..... F27D 3/14

[52] U.S. Cl. ..... 373/79; 373/35; 65/326

[58] Field of Search ..... 373/79, 83, 35, 114, 373/115; 65/325, 326

[56] References Cited

U.S. PATENT DOCUMENTS 469,454 2/1892 Rogers ..... 373/83

2,817,695 12/1957 Hartwig ..... 373/114 X

FOREIGN PATENT DOCUMENTS 1133513 7/1962 Fed. Rep. of Germany ..... 373/115

*Primary Examiner*—Roy N. Envall, Jr.

*Attorney, Agent, or Firm*—Herbert L. Lerner; Laurence A. Greenberg

[57] ABSTRACT

A method for tapping a furnace contains a tappable melt of silicon dioxide to be reduced to silicon with carbon, which comprises providing a graphite tap pipe on the furnace, and electrically heating the tap pipe to cause liquid silicon to flow out of the pipe, and a device for carrying out the method.

4 Claims, 2 Drawing Figures

METHOD AND DEVICE FOR TAPPING A FURNACE CONTAINING A TAPPABLE MELT

Figure 2:
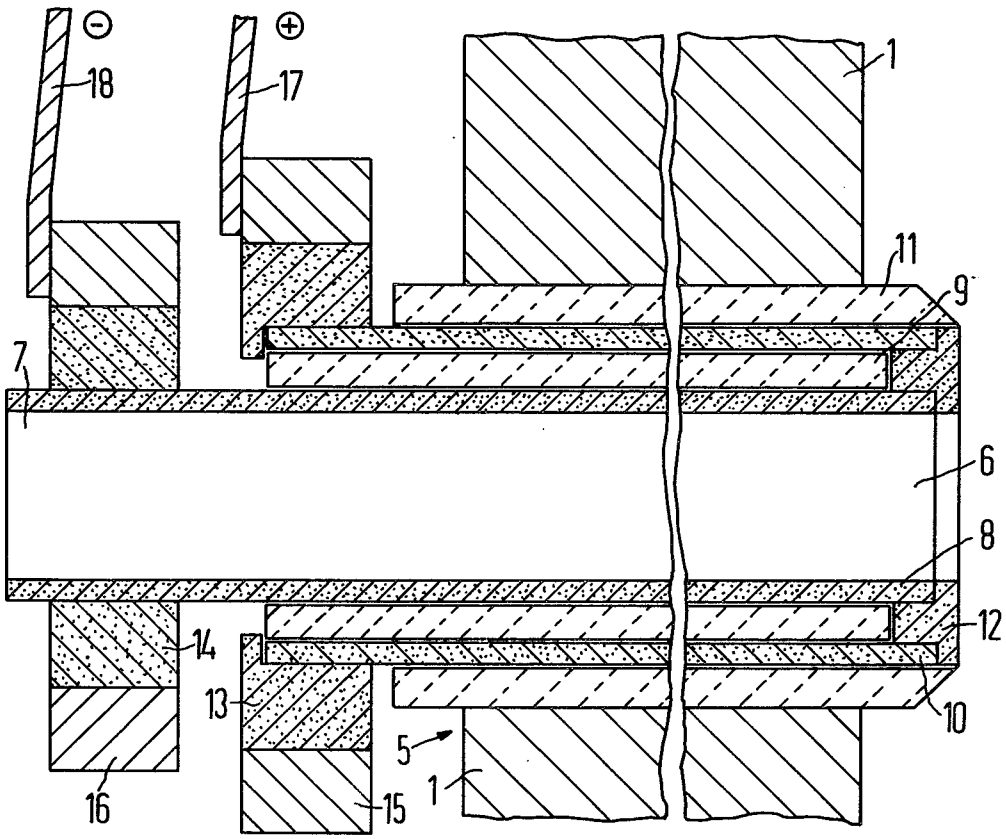

The invention relates to a method and device for tapping a furnace containing a tappable melt, in particular an arc or electric arc furnace, in which commercial silicon dioxide is preferably reduced to silicon with carbon, and which is provided with a tap pipe.

Silicon, which can be used in particular for solar cells, can be pre-fabricated in an arc furnace by reducing commercial silicon dioxide as is known, by means of carbon. The silicon obtained in this way is then converted into a silicon body by means of a strip injection method (as shown in German Published, Non-Prosecuted Application DE-OS No. 31 28 979), for example, or by means of a centrifugal or spraying method (as seen in German Published, Non-Prosecuted Application No.31 29 009).

The melting of the mixture composed of commercial silicon dioxide and carbon is carried out by supplying heat across three graphite electrodes, for example, each of which is connected to a three-phase current phase and which are introduced from above into the interior of the trough-like furnace. A particularly critical feature of this silicon production is the tapping of the furnace, since a temperature of approximately 1600° C. to 2000° C. prevails in the furnace itself and the tapping has to be effected without specific tools as such, since the use thereof would otherwise lead to the pollution of the silicon. Various tapping methods are in fact already known, such as for example burning an opening in the lower region of the furnace by means of an auxiliary electrode, or shooting or depositing a pellet into the furnace, etc. However, all these methods are based upon mechanical action and thus are likely to result in pollution of the silicon.

It is accordingly on object of the invention to provide a method and device for tapping a furnace containing a tappable melt which overcomes the hereinafore-mentioned disadvantages of the heretofore-known methods and devices of this general type, wherein no mechanical action is needed.

With the foregoing and other objects in view there is provided, in accordance with the invention, a method for tapping a furnace, especially an arc or electric furnace, containing a tappable melt of silicon dioxide, preferably commecial silicon dioxide, to be reduced to silicon with carbon, which comprises providing a graphite tap pipe on the furnace, and electrically heating the tap pipe to cause liquid silicon flow out of the tap pipe.

Thus in the invention the tapping is effected solely by electrical heating of the tap pipe whereby the silicon which was previously in solid form in the pipe is converted into the liquid phase, so that the silicon contained in the furnace can be discharged from the furnace through the pipe.

In order to carry out the method, there is provided a device for tapping a furnace containing a tappable melt, comprising a tap pipe disposed on the furnace, the tap pipe including an inner graphite pipe, an outer graphite pipe, a contact ring connected from the inner graphite pipe to the outer graphite pipe, a first electrical contact disposed on the inner graphite pipe at a given side of the tap pipe, and a second electrical contact disposed on the outer graphite pipe at the given side of the tap pipe for electrical heating.

In accordance with another feature of the invention, the electrical contacts are copper pressure contacts, and including a graphite ring respectively connected between each of the electrical contacts and the graphite pipes.

In accordance with a concomitant feature of the invention, there is provided a first ceramic pipe disposed between the inner and outer graphite pipes, and a second ceramic pipe surrounding the outer graphite pipe.

Advantageously, the first ceramic pipe is free of aluminum oxide and the second ceramic pipe is free of aluminum oxide. The regulatable alternating current which flows across the copper pressure contacts has a current strength of approximately 1000 A and the voltage drop amounts to approximately 10 V.

Other features which are considered as characteristic for the invention are set forth in the appended claims.

Although the invention is illustrated and described herein as embodied in a method and device for tapping a furnace containing a tappable melt, it is nevertheless not intended to be limited to the details shown, since various modifications and structural changes may be made therein without departing from the spirit of the invention and within the scope and range of equivalents of the claims.

Figure 1:
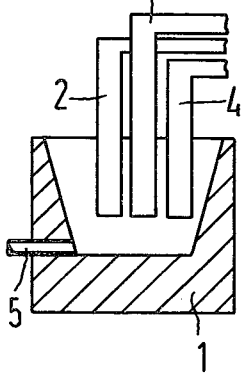

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of an arc furnace; and FIG. 2 is another fragmentary cross-sectional view through the tap pipe of the arc furnace illustrated in FIG. 1.

Referring now to the figures of the drawing and first particularly to FIG. 1 thereof, there is seen an arc furnace 1 formed of a fire-resistant material having a tube-shaped or trough-like opening into which graphite electrodes 2, 3 and 4 project from above. Each of the electrodes 2, 3 and 4 is connected to a phase of a three-phase current. In vicinity of the bottom surface of the opening in the base of the arc furnace 1, a tap pipe 5 which leads outwardly from the interior of the furnace 1, is provided.

The tap pipe 5 is represented in an enlarged sectional view in FIG. 2. The tap pipe 5 leads from an opening 6 formed on the side of the melt, in other words from the interior of the furnace 1, to an opening 7 formed on the tapping side, at the exterior of the furnace 1.

The tap pipe 5 itself is formed of an inner graphite pipe 8, the outer surface or shell of which is provided with a first ceramic pipe 9 which is free of aluminum oxide. This ceramic pipe 9 which is free of aluminum oxide is in contact with an outer graphite pipe 10 which in turn is enclosed by a second ceramic pipe 11 that is free of aluminum oxide. A graphite contact ring 12 which is screwed between the inner and outer graphite pipes 8, 10, serves to provide an electrical connection between the pipes 8 and 10 and to reliably prevent the melt from penetrating between the individual pipes.

On the tapping side, two graphite rings 13 and 14 are respectively provided on the outer graphite pipe 10 and on the inner graphite pipe 8. Each graphite ring 13, 14 is respectively surrounded by a copper pressure contact 15, 16. By means of an alternating voltage source, currents of approximately 1000 A can be supplied through the pressure contacts 15 and 16, whereby the voltage drop amounts to approximately 10 V.

First of all, while in operation during the time that the mixture of silicon dioxide and carbon is heated in the interior of the furnace 1, no voltage is connected to the pressure contacts 15 and 16. The silicon arising from the reduction process ($T \approx 1650°$ C.) then penetrates into the pipe 5 where it solidifies, as it cools to below the melting point of approximately 1420° C. on the tapping side. If the furnace 1 now has to be tapped, the voltage source is switched on, permitting an alternating current to flow across a conductor 17, the copper pressure contact 15, the graphite ring 13 the outer graphite pipe 10, the contact ring 12, the inner graphite pipe 8, the graphite ring 14, and the copper pressure contact 16 to a conductor 18. As a result, the solidified silicon inside the pipe 5 is converted into the liquid phase so that it can flow out of the interior of the furnace 1.

In this way, the invention provides a method and a device for tapping a furnace containing a tappable melt, which functions without any mechanical action. This ensures that the silicon is not at all polluted by the tapping process itself.

The foregoing is a description corresponding to German application No. P 32 11 525.3, dated Mar. 29, 1982, the International priority of which is being claimed for the instant application, and which is hereby made part of this application. Any discrepancies between the foregoing specification and the aforementioned corresponding German application are to be resolved in favor of the latter.

We claim:

1. Device for tapping a furnace containing a tappable melt, comprising a tap pipe disposed on the furnace, said tap pipe including an inner graphite pipe, an outer graphite pipe, a contact ring connected from said inner graphite pipe to said outer graphite pipe, a first electrical contact disposed on said inner graphite pipe outside said furnace at a given side of said tap pipe, and a second electrical contact disposed on said outer graphite pipe outside said furnace at said given side of said tap pipe for electrical heating.

2. Device for tapping a furnace containing a tappable melt of silicon dioxide to be reduced to silicon with carbon, comprising a tap pipe having an end disposed on the furnace and having sides, said tap pipe including an inner graphite pipe, an outer graphite pipe, a contact ring connected from said inner graphite pipe to said outer graphite pipe, a first electrical contact disposed on said inner graphite pipe outside said furnace at a given one of said sides of said tap pipe, and a second electrical contact disposed on said outer graphite pipe outside said furnace at said same given side of said tap pipe for electrical heating causing silicon to flow out of said tap pipe.

3. Device according to claim 2, wherein said electrical contacts are copper pressure contacts, and including a graphite ring respectively connected between each of said electrical contacts and said graphite pipes.

4. Device according to claim 2, including a first ceramic pipe disposed between said inner and outer graphite pipes, and a second ceramic pipe surrounding said outer graphite pipe.

* * * * *